US005517282A

United States Patent [19]

Yamashita et al.

[11] Patent Number: 5,517,282

[45] Date of Patent: *May 14, 1996

[54] MANAGEMENT SYSTEM OF IMAGE FORMING APPARATUSES

[75] Inventors: Yuji Yamashita; Masanobu Takahashi; Katsunori Masai; Hiroyuki Inenaka; Masahiro Sako; Yasuhiro Hashimoto; Hideaki Tomita, all of Osaka, Japan

[73] Assignee: Mita Industrial Co., Ltd., Japan

[ * ] Notice: The term of this patent shall not extend beyond the expiration date of Pat. No. 5,343,276.

[21] Appl. No.: 297,111

[22] Filed: Aug. 26, 1994

Related U.S. Application Data

[63] Continuation-in-part of Ser. No. 67,138, May 26, 1993, Pat. No. 5,343,276.

[30] Foreign Application Priority Data

May 27, 1992 [JP] Japan ..... 4-162121

[51] Int. Cl.[6] ..... G03G 21/00

[52] U.S. Cl. ..... 355/202; 355/200; 355/203; 355/207; 355/208

[58] Field of Search ..... 355/200, 202, 355/203, 204, 205, 206, 207, 208; 371/29.1, 16.4; 364/550, 551.01, 525, 570, 571.01, 571.02, 267, 267.1, 267.8, 919.1, 930.42, 942.5, 942.6; 350/825.6, 825.15, 825.16

[56] References Cited

U.S. PATENT DOCUMENTS

| | | | |
|---|---|---|---|
| 4,167,322 | 9/1979 | Yano et al. | 355/204 X |
| 4,497,037 | 1/1985 | Kato et al. | 355/202 X |
| 4,583,834 | 4/1986 | Sko et al. | 355/206 |
| 5,084,875 | 1/1992 | Weinberger et al. | 355/205 X |
| 5,184,179 | 2/1992 | Tarr et al. | 355/206 |
| 5,212,802 | 5/1993 | Matsumoto | 355/202 |
| 5,216,461 | 6/1993 | Maekawa et al. | 355/202 |
| 5,220,380 | 1/1993 | Hirata et al. | 355/204 |
| 5,270,775 | 12/1993 | Suzuki | 355/204 |
| 5,282,127 | 6/1994 | Mii | 355/206 X |
| 5,291,420 | 3/1994 | Matsumoto et al. | 355/204 X |
| 5,343,276 | 8/1994 | Yamashita et al. | 355/202 |

FOREIGN PATENT DOCUMENTS 59-142559 8/1984 Japan .

OTHER PUBLICATIONS

Research Newsletter, Ritter, Lynn S., "Remote Diagnostics—Tool Kit of the Future", DataQuest Inc. Feb. 1989.

*Primary Examiner*—Matthew S. Smith

*Attorney, Agent, or Firm*—Beveridge, DeGrandi, Weilacher & Young

[57] ABSTRACT

A management system of image forming apparatuses according to the present invention includes a device for transmitting information about maintenance for each of a plurality of image forming apparatuses such as copying machines, and transmitting for example, the number of copies from the image forming apparatus to a centralized management apparatus. It further includes a device for determining, on the basis of maintenance information transmitted from the image forming apparatus to the centralized management apparatus, efficient performance of maintenance work, for example, the scheduled date of maintenance work for the image forming apparatus. The above described information about maintenance is related to the operation of the peripheral device. For example, if the peripheral device is an automatic document feeder, information related to efficiently performing maintenance work may be the number of sheets fed by the automatic document feeder, whereas if the peripheral device is a sorter, such information may be the number of sheets fed to the sorter.

20 Claims, 12 Drawing Sheets

FIG. 2

| ID | K | AK | TKD | TK | D |
|---|---|---|---|---|---|
| 1 | | | | | |
| 2 | | | | | |
| 3 | | | | | |
| ⋮ | | | | | |

FIG. 3

| ID | D | EC |
|---|---|---|
| 4 | April 10 | A (a) |
| 5 | April 12 | B (b) |
| 6 | April 12 | C (d) |
| 8 | April 12 | D (b) |
| 11 | April 12 | B (d) |
| 15 | April 12 | D (c) |
| 20 | April 12 | C (b) |
| 7 | April 13 | A (b) |
| 12 | April 13 | A (c) |
| ⋮ | ⋮ | ⋮ |

FIG. 5

20

| | | | |
|---|---|---|---|
| 6 | 5 | 4 | 3 |
| 7 | 8 | 1 | 2 |
| 10 | 9 | 16 | 15 |
| 11 | 12 | 13 | 14 |

FIG. 6

20

| | | | |
|---|---|---|---|
| 6 ☆ | 5 | 4 | 3 |
| 7 | 8 ☆ | 1 | 2 |
| 10 ☆ | 9 | 16 ☆ | 15 |
| 11 | 12 ☆ | 13 ☆ | 14 |

MANAGEMENT SYSTEM OF IMAGE FORMING APPARATUSES

CONTINUING APPLICATION INFORMATION

This application is a continuation-in-part application of U.S. patent application Ser. No. 08/067,138, filed May 26, 1993, which issued as U.S. Pat. No. 5,343,276 on Aug. 30, 1994, entitled "Management System Of Image Forming Apparatuses," which is incorporated entirely herein by reference.

BACKGROUND OF THE INVENTION

1. Field of the Invention

The present invention relates to a management system of image forming apparatuses such as copying machines, and of peripheral devices which are used with image forming apparatuses, such as automatic document feeders, sorters, paper feeding disk devices, staplers, punching devices, binding devices, and heaters.

2. Description of the Prior Art

The maintenance work for a copying machine and its peripheral devices is generally performed when the number of copies made by the copying machine reaches a predetermined number. Conventionally, information about the number of copies made by a copying machine has been obtained by the visit of a service man to a customer or contact from the customer. Specifically, the scheduled date of the maintenance work of the copying machine has been determined on the basis of information which can be known when the service man visits the customer or upon the request for maintenance from the customer. Accordingly, it is difficult to predetermine the scheduled date of maintenance work, so that the efficiency of the maintenance work is not high.

SUMMARY OF THE INVENTION

An object of the present invention is to provide a management system of image forming apparatuses and their peripheral devices which is capable of increasing the efficiency of the maintenance work of the image forming apparatuses and their peripheral devices.

A first management system of image forming apparatuses according to the present invention is characterized by comprising means for transmitting information about maintenance of each of a plurality of image forming apparatuses from the image forming apparatus to a centralized management apparatus through transmitting means, and means for finding, on the basis of the information about maintenance which is transmitted from the image forming apparatus to the centralized management apparatus, information for efficiently performing the maintenance work of the image forming apparatus.

The above described information about maintenance is, for example, the number of formed images. The above described information for efficiently performing the maintenance work is, for example, the scheduled date of the succeeding or subsequent maintenance work or the order in which the plurality of image forming apparatuses which are scheduled to be maintained on the same date or on dates close to each other are visited for the maintenance work.

A second management system of image forming apparatuses according to the present invention is characterized by comprising means for transmitting the number of copies made by each of a plurality of copying machines from the copying machine to a centralized management apparatus through transmitting means, and means for finding, on the basis of the number of copies which is transmitted from the copying machine to the centralized management apparatus, information for efficiently performing the maintenance work of the copying machine.

The above described information for efficiently performing the maintenance work is, for example, the scheduled date of the succeeding maintenance work or the order in which the plurality of copying machines which are scheduled to be maintained on the same date or on dates close to each other are visited for the maintenance work.

A third management system of image forming apparatuses according to the present invention is characterized by comprising means for transmitting the number of copies made by each of a plurality of copying machines from the copying machine to a centralized management apparatus through transmitting means, and means for finding, on the basis of the number of copies which is transmitted from the copying machine to the centralized management apparatus, the scheduled date of the maintenance work of the copying machine.

The number of copies for a predetermined time period actually made by each of the plurality of copying machines is transmitted from the copying machine to the centralized management apparatus for each predetermined time period.

A first management system of peripheral devices for image forming apparatuses according to the present invention comprises means for transmitting information about maintenance of a peripheral device from the peripheral device to a centralized management apparatus through transmitting means, and means for finding, on the basis of the information about maintenance which is transmitted from the peripheral device to the centralized management apparatus, information for efficiently performing the maintenance work of the peripheral device.

The above described information about maintenance is related to the operation of the peripheral device. For example, if the peripheral device is an automatic document feeder, the information about maintenance work may be the number of sheets fed by the automatic document feeder, while if the peripheral device is a sorter, the information may be the number of sheets fed to the sorter. The information for efficiently performing maintenance work on these types of peripheral devices may be the scheduled date of the subsequent maintenance work or the order in which a plurality of peripheral devices which are scheduled to be maintained on the same date or on dates close to each other are visited for the maintenance work.

The above described centralized management apparatus will vary depending upon the device for which it provides information about maintenance. For example, if the centralized management apparatus provides information for efficiently maintaining an image forming device, it comprises storing means having a daily average copy number storage area storing the average number of copies per day, a scheduled total copy number storage area previously storing the scheduled total number of copies made from the time when the maintenance work is performed until the succeeding maintenance work is performed, and a total copy number storage area storing the total number of copies made from the time when the maintenance work is performed up to the present time provided for each copying machine. It also has means for finding, on the basis of the number of copies for the predetermined time period which is transmitted from the copying machine for each predetermined time period, the average number of copies per day made by the copying machine and storing the same in the daily average copy number storage area; means for finding, on the basis of the number of copies for the predetermined time period which is transmitted from the copying machine for each predetermined time period, the total number of copies made from the time when the maintenance work is performed up to the present time by the copying machine and storing the same in the total copy number storage area; means for subtracting the total number of copies which is stored in the total copy number storage area from the scheduled total number of copies which is stored in the scheduled total copy number storage area for the copying machine dividing the result of the subtraction by the average number of copies per day which is stored in the daily average copy number storage area to find the difference between the scheduled date o the succeeding maintenance work and the present date, and finding the scheduled date of the succeeding maintenance work on the basis of the difference and the present date; and, means for reporting the scheduled date of the succeeding or subsequent maintenance work found.

If the centralized management apparatus provides information for efficiently maintaining an automatic document feeder, the centralized management apparatus comprises storing means having a first storage area for storing the average number of sheets fed by the automatic document feeder per day, a second storage area for previously storing the scheduled total number of sheets fed by the automatic document feeder from the time when the preceding maintenance work is performed until the subsequent maintenance work is to be performed, and a third storage area storing the total number of sheets fed by the automatic document feeder from the time when the preceding maintenance work was performed up to the present time. The centralized management apparatus also includes means for finding, on the basis of the number of sheets for the predetermined time period which is fed from the transmitting means for each predetermined time period, the average number of sheets fed per day and storing the same in the first storage area, means for finding, on the basis of the number of sheets for the predetermined time period which is fed from the transmitting means for each predetermined time period, the total number of sheets fed by the automatic document feeder from the time when the preceding maintenance work was performed up to the present time and storing the same in the third storage area, means for subtracting the total number of sheets which is stored in the third storage area from the scheduled total number of sheets which is stored in the second storage area, dividing the result of the subtraction by the average number of sheets fed per day to find the difference between the scheduled date of the succeeding maintenance work and the present date, and finding the scheduled date of the succeeding maintenance work on the basis of the difference and the present date, and means for reporting the scheduled date of the succeeding maintenance work found.

If the centralized management apparatus provides information for efficiently maintaining a sorter based upon the number of sheets fed to the sorter, the centralized management apparatus comprises storing means with a first storage area for storing the average number of paper sheets fed to the sorter per day, a second storage area for previously storing the scheduled total number of paper sheets fed to the sorter from the time when the preceding maintenance work is performed until the succeeding or subsequent maintenance work is to be performed, and a third storage area storing the total number of paper sheets fed to the sorter from the time when the preceding maintenance work was performed up to the present time. The centralized management apparatus also includes means for finding, on the basis of the number of paper sheets for the predetermined time period which is fed from the transmitting means for each predetermined time period, the average number of paper sheets per day and storing the same in the first storage area, means for finding, on the basis of the number of paper sheets for the predetermined time period which is fed from the transmitting means for each predetermined time period, the total number of paper sheets fed to the sorter from the time when the preceding maintenance work was performed up to the present time and storing the same in the third storage area, means for subtracting the total number of paper sheets which is stored in the third storage area from the scheduled total number of paper sheets which is stored in the second storage area, dividing the result of the subtraction by the average number of paper sheets per day to find the difference between the scheduled date of the succeeding maintenance work and the present date, and finding the scheduled date of the succeeding maintenance work on the basis of the difference and the present date, and means for reporting the scheduled date of the succeeding or subsequent maintenance work found.

If, on the other hand, the centralized management apparatus provides information for efficiently maintaining=e.m. a sorter based upon the number of times that bins in the sorter are moved, the centralized management apparatus includes storing means with a first storage area for storing the average number of times of movement of the bins in the sorter per day, a second storage area for previously storing the scheduled total number of times of movement of the bins in the sorter from the time when the preceding maintenance work is performed until the subsequent maintenance work is to be performed, and a third storage area for storing the total number of times of movement of the bins in the sorter from the time when the preceding maintenance work was performed up to the present time. The centralized management apparatus also has means for finding, on the basis of the number of times of movement of the bins for the predetermined time period which is fed from the transmitting means for each predetermined time period, the average number of times of movement of the bins per day and storing the same in the first storage area, means for finding, on the basis of the number of times of movement of the bins for the predetermined time period which is fed from the transmitting means for each predetermined time period, the total number of times of movement of the bins in the sorter from the time when the preceding maintenance work was performed up to the present time and storing the same in the third storage area, means for subtracting the total number of times of movement of the bins which is stored in the third storage area from the scheduled total number of times of movement of the bins which is stored in the second storage area, dividing the result of the subtraction by the average number of times of movement of the bins per day to find the difference between the scheduled date of the subsequent maintenance work and the present date, and finding the scheduled date of the subsequent maintenance work on the basis of the difference and the present date, and means for reporting the scheduled date of the subsequent maintenance work calculated by centralized management apparatus.

When the centralized management apparatus provides information for e.m. a paper feeding disk device, the centralized management apparatus comprises storing means with a first storage area for storing the average number of paper sheets fed by the paper feeding disk device per day, a second storage area for previously storing the scheduled total number of paper sheets fez by the paper feeding disk device from the time when the preceding maintenance work is performed until the subsequent maintenance work is to be performed, and a third storage area for storing the total number of paper sheets fed by the paper feeding disk device from the time when the preceding maintenance work was performed up to the present time. The centralized management apparatus also includes means for finding, on the basis of the number of paper sheets for the predetermined time period which is fed from the transmitting means for each predetermined time period, the average number of paper sheets per day and storing the same in the first storage area, means for finding, on the basis of the number of paper sheets for the predetermined time period which is fed from the transmitting means for each predetermined time period, the total number of paper sheets fed by the paper feeding disk device from the time when the preceding maintenance work was performed up to the present time and storing the same in the third storage area, means for subtracting the total number of paper sheets fed which is stored in the third storage area from the scheduled total number of paper sheets fed which is stored in the second storage area, dividing the result of the subtraction by the average number of paper sheets fed per day to find the difference between the scheduled date of the succeeding maintenance work and the present date, and finding the scheduled date of the succeeding maintenance work on the basis of the difference and the present date, and means for reporting the scheduled date of the succeeding maintenance work thus found.

If the centralized management apparatus is employed to provide information for e.m. a stapler, the centralized management apparatus includes storing means which is provided with a first storage area for storing the average number of times of stapling by the stapler per day, a second storage area for previously storing the scheduled total number of times of stapling by the stapler from the time when the preceding maintenance work is performed until the subsequent maintenance work is to be performed, and a third storage area for storing the total number of times of stapling by the stapler from the time when the preceding maintenance work was performed up to the present time. The centralized management apparatus also includes means for finding, on the basis of the number of times of stapling for the predetermined time period which is fed from the transmitting means for each predetermined time period, the average number of times of stapling per day and storing the same in the first storage area, means for finding, on the basis of the number of times of stapling for the predetermined time period which is fed from the transmitting means for each predetermined time period, the total number of times of stapling by the stapler from the time when the preceding maintenance work was performed up to the present time and storing the same in the third storage area, means for subtracting the total number of times of stapling which is stored in the third storage area from the scheduled total number of times of stapling which is stored in the second storage area, dividing the result of the subtraction by the average number of times of stapling per day to find the difference between the scheduled date of the succeeding maintenance work and the present date, and finding the scheduled date of the succeeding maintenance work on the basis of the difference and the present date, and means for reporting the scheduled date of the subsequent maintenance work found.

If the centralized management apparatus provides information for e.m. a punching device, it includes storing means which is provided with a first storage area for storing the average number of times of punching by the punching device per day, a second storage area for previously storing the scheduled total number of times of punching by the punching device from the time when the preceding maintenance work is performed until the succeeding maintenance work is to be performed, and a third storage area for storing the total number of times of punching by the punching device from the time when the preceding maintenance work was performed up to the present time. The centralized management apparatus also includes means for finding, on the basis of the number of times of punching for the predetermined time period which is fed from the transmitting means for each predetermined time period, the average number of times of punching by the punching device per day and storing the same in the first storage area, means for finding, on the basis of the number of times of punching for the predetermined time period which is fed from the transmitting means for each predetermined time period, the total number of times of punching by the punching device from the time when the preceding maintenance work was performed up to the present time and storing the same in the third storage area, means for subtracting the total number of times of punching which is stored in the third storage area from the scheduled total number of times of punching which is stored in the second storage area, dividing the result of the subtraction by the average number of times of punching per day to find the difference between the scheduled date of the subsequent maintenance work and the present date, and finding the scheduled date of the subsequent maintenance work on the basis of the difference and the present date, and means for reporting the scheduled date of the subsequent maintenance work thus calculated.

If the centralized management system provides information for e.m. a binding machine based upon the paste used for binding, the centralized management system comprises storing means which is provided with a first storage area for storing the average number of times of binding by the binding device per day, a second storage area for previously storing the scheduled total number of times of binding by the binding device from the time when the preceding maintenance work was performed until the succeeding or subsequent maintenance work is to be performed, and a third storage area for storing the total number of times of binding by the binding device from the time when the preceding maintenance work was performed up to the present time. The centralized management apparatus also includes means for finding, on the basis of the number of times of binding for the predetermined time period which is fed from the transmitting means for each predetermined time period, the average number of times of binding per day and storing the same in the first storage area, means for finding, on the basis of the number of times of binding for the predetermined time period which is fed from the transmitting means for each predetermined time period, the total number of times of binding by the binding device from the time when the preceding maintenance work was performed up to the present time and storing the same in third storage area, means for subtracting the total number of times of binding which is stored in the third storage area from the scheduled total number of times of binding which is stored in the second storage area, dividing the result of the subtraction by the average number of times of binding per day to find the difference between the scheduled date of the succeeding maintenance work and the present date, and finding the scheduled date of the subsequent maintenance work on the basis of the difference and the present date, and means for reporting the scheduled date of the subsequent maintenance work found.

If, on the other hand, the centralized management apparatus provides information for e.m. a binder based upon the use of a heater for pasting and heating a plurality of sheets, the centralized management apparatus includes storing means which is provided with a first storage area for storing the average driving time of the heater per day, a second storage area for previously storing the scheduled total driving time of the heater from the time when the preceding maintenance work was performed until the subsequent maintenance work is to be performed, and a third storage area for storing the total driving time of the heater from the time when the preceding maintenance work is performed up to the present time. The centralized management apparatus also includes means for finding, on the basis of the driving time for the predetermined time period which is fed from the transmitting means for each predetermined time period, the average driving time per day and storing the same in the first storage area, means for finding, on the basis of the driving time for the predetermined time period which is fed from the transmitting means for each predetermined time period, the total driving time of the binding device from the time when the preceding maintenance work was performed up to the present time and storing the same in the third storage area, means for subtracting the total driving time which is stored in the third storage area from the scheduled total driving time which is stored in the second storage area, dividing the result of the subtraction by the average driving time per day to find the difference between the scheduled date of the succeeding maintenance work and the present date, and finding the scheduled date of subsequent maintenance work on the basis of the difference and the present date, and means for reporting the scheduled date of the subsequent maintenance work thus calculated.

Finally, if the centralized management supplies information for e.m. a warm heater for heating paper in a feeding disk device, it comprises storing means with a first storage area for storing the average driving time of the warm heater per day, a second storage area for previously storing the scheduled total driving time of the warm heater from the time when the preceding maintenance work is performed until the subsequent maintenance work is to be performed, and a third storage area for storing the total driving time of the warm heater from the time when the preceding maintenance work was performed up to the present time. The centralized management apparatus also includes means for finding, on the basis of the driving time for the predetermined time period which is fed from the transmitting means for each predetermined time period, the average driving time per day and storing the same in the first storage area, means for finding, on the basis of the driving time for the predetermined time period which is fed from the transmitting means for each predetermined time period, the total driving time of the warm heater from the time when the preceding maintenance work was performed up to the present time and storing the same in the third storage area, means for subtracting the total driving time which is stored in the third storage area from the scheduled total driving time which is stored in the second storage area, dividing the result of the subtraction by the average driving time per day to find the difference between the scheduled date of the subsequent maintenance work and the present date, and calculating the scheduled date of the subsequent maintenance work on the basis of the difference and the present date, and means for reporting the scheduled date of the subsequent maintenance work thus calculated.

Examples of the above described means for reporting the scheduled date of the succeeding maintenance work include a display device, a printing device and the like.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a schematic diagram showing a part of the contents of a memory device 13;

FIG. 3 is a schematic diagram showing a part of the contents of the memory device 13;

FIG. 5 is a schematic diagram showing a state where small number plates are respectively assigned imaginarily to small blocks in the service area;

FIG. 6 is a schematic diagram showing small blocks in which there exist six customers for which the maintenance work is scheduled to be performed on the same date out of customers in the service area;

DESCRIPTION OF THE PREFERRED EMBODIMENTS

Figure 1:
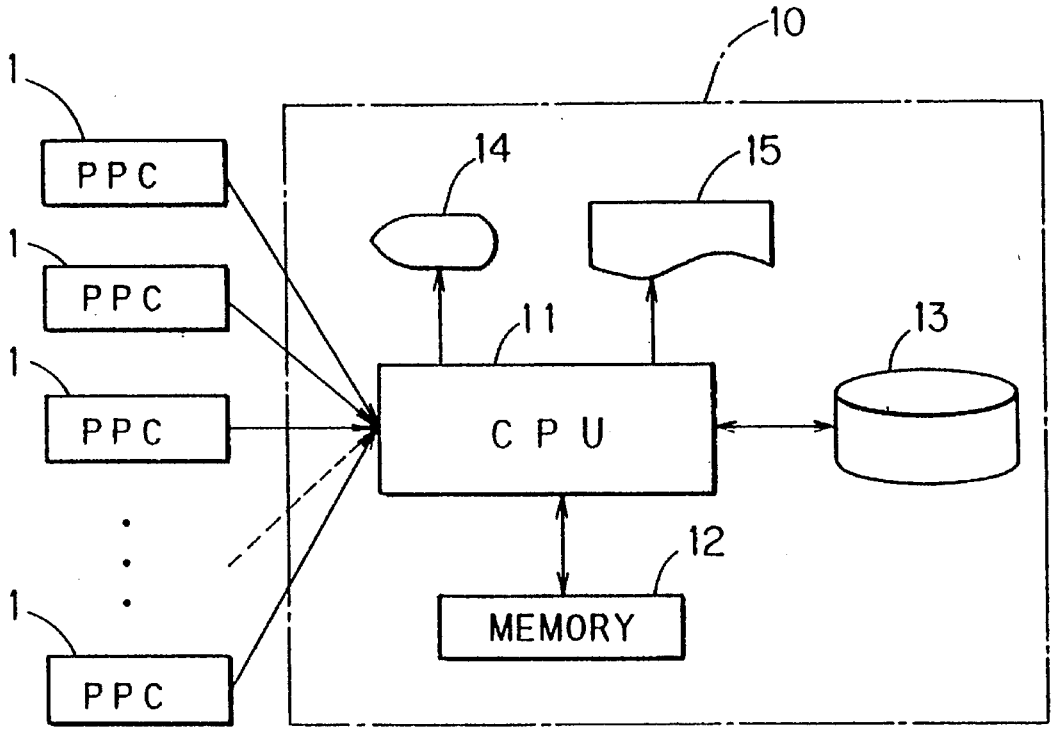
FIG. 1 is a block diagram showing a management system of copying machines according to one embodiment of the invention.

Referring now to the drawings, description is made of an embodiment in a case where the present invention is applied to a management system of copying machines.

FIG. 1 shows a management system of copying machines. The management system of copying machines comprises a centralized management apparatus 10 for collecting information about maintenance (hereinafter referred to as maintenance information) from copying machines 1 respectively installed in a plurality of customers and managing the same. The maintenance information is transmitted to the centralized management apparatus 10 from each of the copying machines 1 by wire transmission or wireless transmission.

The centralized management apparatus 10 comprises a memory device 13 for storing maintenance information, geographic information about a service area and the other necessary information in addition to a central processing unit (CPU) 11 and a memory device 12 for storing its program. In addition, the centralized management apparatus 10 comprises a display device 14 such as a CRT (Cathode Ray Tube) and a printing device 15 such as a printer.

The centralized management apparatus 10 finds, for example, the scheduled date of the maintenance work on the basis of the maintenance information which is transmitted from each of the copying machines 1, and displays the date on the display device 14 and prints the date by the printing device 15. The scheduled date of the maintenance work is found in the following manner.

In the memory device 13, areas respectively storing the number of copies per day K actually made by each of the copying machines 1, the average number of copies per day AK, the scheduled total number of copies made from the time when the maintenance work is performed until the succeeding maintenance work is to be performed TKO, the total number of copies made from the time when the maintenance work is performed up to the present time TK, and the scheduled date of the subsequent maintenance work D are provided for each copying machine (for each customer number ID), as shown in FIG. 2.

The number of copies per day K is transmitted every day from each of the copying machines 1. The average number of copies per day AK is found on the basis of the number of copies which is transmitted from the copying machine 1, and is updated every day. The scheduled total number of copies made from the time when the maintenance work is performed until the subsequent maintenance work is to be performed TKO is previously set and stored in the memory device 13. The total number of copies made from the time when the maintenance work is performed up to the present time TK is found on the basis of the number of copies which is transmitted from the copying machine 1, and is updated every day. The scheduled date of the succeeding maintenance work D is found in the following manner, and is updated every day.

First, the number of days X between the scheduled date of the succeeding maintenance work D and the present date is found by the following equation (1):

$$X=(TKO-TK)/AK \quad (1)$$

A date after an elapse of the number of days X from the present date is found, and the date is taken as the scheduled date of the succeeding maintenance work D.

For example, it is assumed that the present date is Apr. 10, the scheduled total number of copies made from the time when the maintenance work is performed until the succeeding or subsequent maintenance work is performed TKO is 35000, the average number of copies per day AK is 100, and the total number of copies made from the time when the maintenance work is performed up to the present time TK is 34000. In this case, the number of days X between the scheduled date of the subsequent maintenance work D and the present date is (35000–34000) / 100 =10, and the scheduled date of the subsequent maintenance work D is Apr. 20.

Information about the place where each of the copying machines 1 is installed may be previously stored to automatically operate a route for efficiently visiting respective copying machines in a group of copying machines which are scheduled to be maintained on dates close to each other on the basis of the information about the place and the scheduled date of the subsequent maintenance work of each of the copying machines 1 which is found in the above described manner and display or print the route. In this case, a road actually utilized may be considered so that the total distance of the route is the minimum distance. In addition, traffic information may be considered in this case to calculate a route which is high in time efficiency. Furthermore, the emergency of the maintenance work may be considered in this case so that such a route that the maintenance work which is particularly urgent is given priority is obtained.

Additionally, a service man, the number of necessary persons, and the like which are suitable for the type of copying machine or the type of maintenance work may be previously registered for each type of copying machine or for each type of maintenance work to automatically display or print a service man, the number of necessary persons, and the like which are suitable for a copying machine to be maintained.

Description is now made of one example of a method of automatically operating a route for efficiently visiting respective copying machines in a group of copying machines (a group of customers) which are scheduled to be maintained on the same date and displaying or printing the route.

The place where a service man for performing the maintenance work of copying machines waits is taken as a service center. In addition, an area where the maintenance work is performed by the service center is taken as a service area.

Figure 4A:
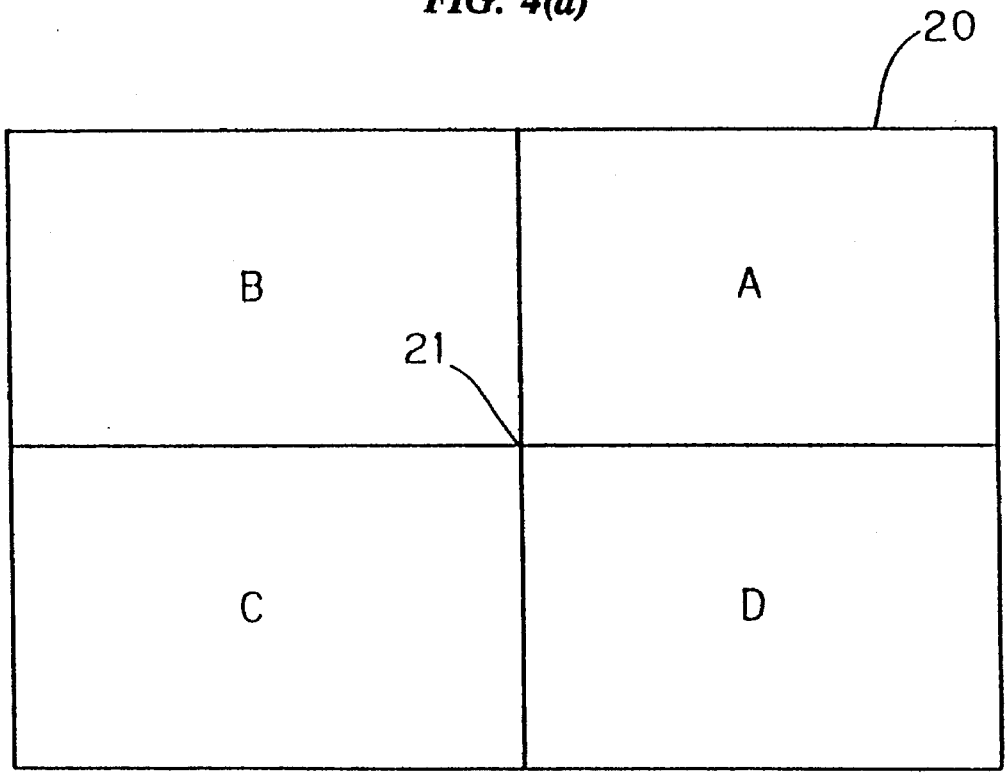
FIG. 4(*a*) and 4(*b*) are schematic diagrams showing a service area.
Figure 4B:
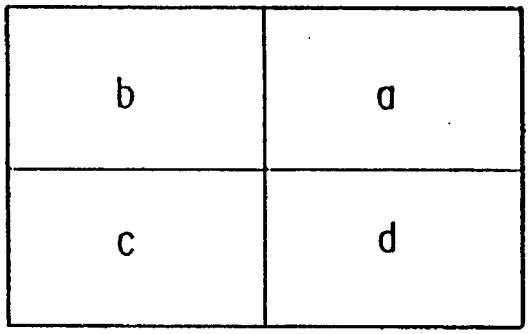

As shown in FIG. 4 (*a*), a service area 20 is set to a rectangular area centered around a service center 21. The service area 20 is divided into four large blocks A, B, C and D of the same size. The large block A, the large block B, the large block C, and the large block D are respectively referred to as a first large block, a second large block, a third large block, and a fourth large block. In addition, each of the large blocks A, B, C and D is divided into four small blocks a, b, c and d of the same size, as shown in FIG. 4 (*b*).

Small number plates given numbers 1 to 16 indicating the order which is suitable for the visit to all the small blocks are previously assigned imaginarily to the 16 small blocks, as shown in FIG. 5. A first large number plate is constituted by the small number plates numbered 1 to 4, a second large number plate is constituted by the small number plates numbered 5 to 8, a third large number plate is constituted by the small number plates numbered 9 to 12, and a fourth large number plate is constituted by the small number plates numbered 13 to 16.

It is assumed that there are a lot of customers in the service area 20, and one copying machine is installed at each of the customers' locations. The respective copying machines are managed by one centralized management apparatus 10.

The memory device 13 stores customer information about maintenance work, as shown in FIG. 3. The customer information about maintenance work is prepared for each customer and in the order of scheduled dates of the maintenance work. Each of the customer information about maintenance work comprises a scheduled date of the maintenance work D which is found in the above described manner, a customer number ID, and an area code EC indicating the place where a customer exists. As the area code EC, a code for designating a small block including the position of a customer is used. For example, an area code A (a) corresponding to a customer given the customer number ID "4" indicates that a customer exists in the small block a in the large block A.

In this example, the scheduled dates of the maintenance work of copying machines installed in six customers are Apr. 12. Therefore, description is made by taking as an example a case where a route for visiting the six customers for the maintenance work is automatically found.

The customer information about maintenance work in the memory device 13 is first retrieved, to extract area codes corresponding to customers for which the maintenance work is to be performed on a predetermined date, Apr. 12 in this example. In FIG. 6, asterisks are respectively assigned to the extracted six small blocks.

A first rule is then applied. Specifically, when there exists a large block in which there exists no customer for which the maintenance work is to be performed on Apr. 12, that is, a large block with no asterisk out of the four large blocks A, B, C and D, the four large number plates are rotated in the counterclockwise direction so that the first large number plate including the small number plate numbered 1 is assigned to a large block one ahead of the large block with no asterisk in the counterclockwise direction.

In this example, the first large plate, the second large plate, the third large plate, and the fourth large plate are respectively assigned to the second large block B, the third large block C, the fourth large block D, and the first large block A by applying the first rule.

Thereafter, a second rule is applied. Specifically, the four small number plates in the large number plate given the larger number out of the large number plates adjacent to each other are so rotated that the small number plate given the smallest number out of the small number plates assigned to the small blocks with asterisks out of the four small number plates in the large number plate is positioned in the same column or the same row as that in which the small number plate given the largest number out of the small number plates assigned to the small blocks with asterisks out of the four small number plates in the other large number plate given the smaller number.

In this case, when there exists no asterisk in the large block assigned the large number plate given the larger number, the four small number plates in the large number plate are so rotated that the small number plate given the smallest number in the large number plate is positioned near the center of the service area. This second rule is sequentially applied in ascending order of numbers given to the large number plates.

Figure 7:
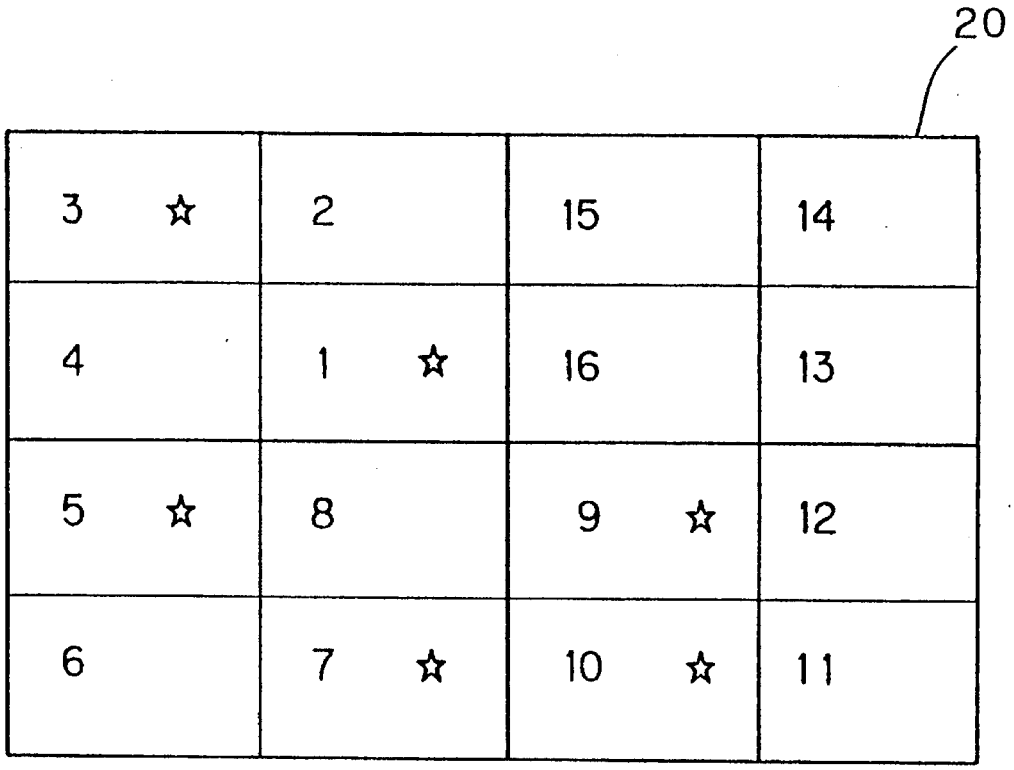
FIG. 7 is a schematic diagram showing the position of large number plates after applying a first rule.
Figure 8:
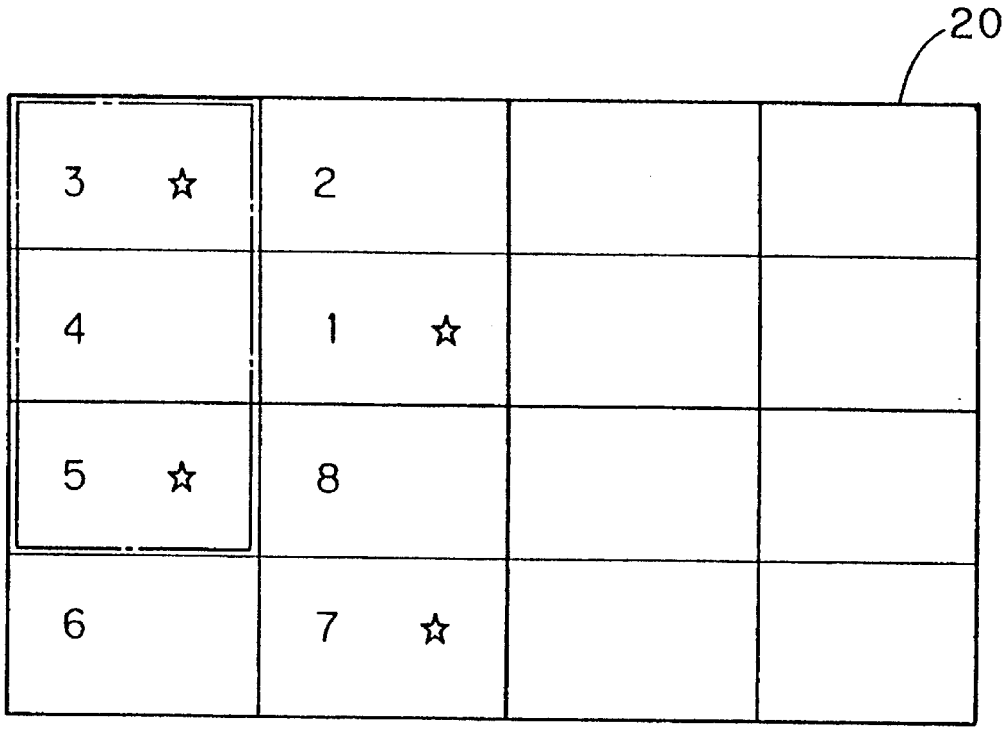
FIG. 8 is a schematic diagram showing the position of small number plates in a second large number plate after applying a second rule between a first large number plate and the second large number plate.

In this example, the second rule is first applied between the first large number plate and the second large number plate shown in FIG. 7. Specifically, the four small number plates in the second large number plate are so rotated that the small number plate given the smallest number (Number 5) out of the small number plates assigned to the small blocks with asterisks out of the four small number plates in the second large number plate is positioned in the same column as that in which the small number plate given the largest number (Number 3) out of the small number plates assigned to the small blocks with asterisks out of the four small number plates in the first large number plate is positioned. In this example, in the step before applying the second rule, the small number plate (Number 3) in the first large number plate and the small number plate (Number 5) in the second large number plate are positioned in the same column, as shown FIG. 8, so that the four small number plates in the second large number plate are not rotated.

Figure 9:
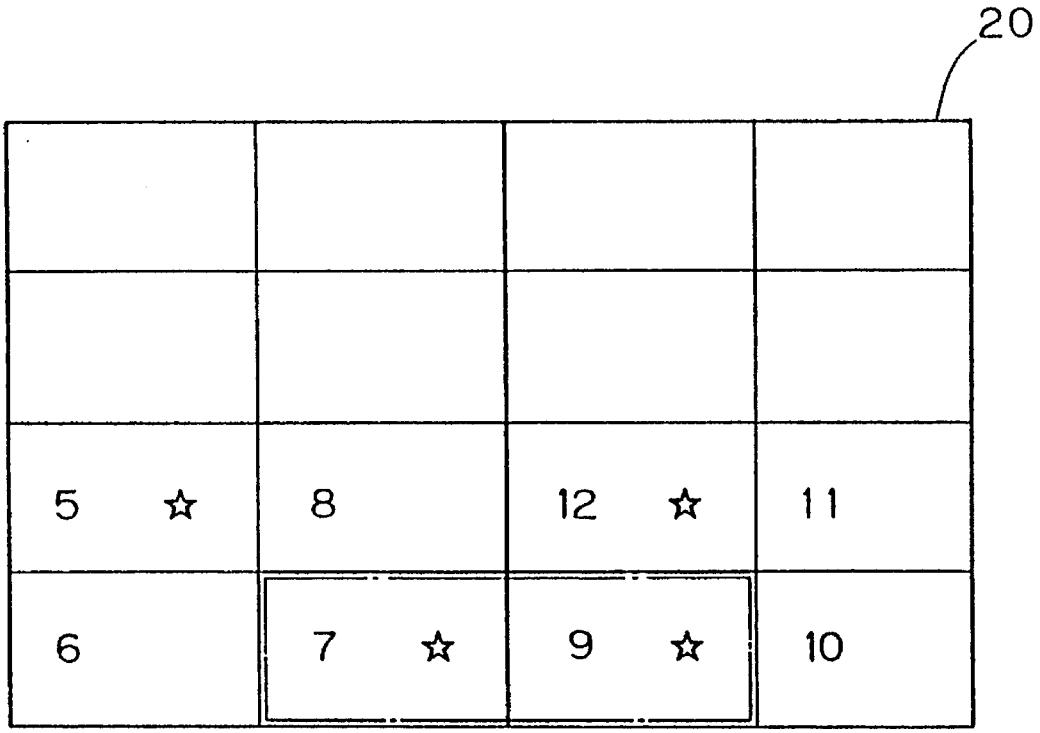
FIG. 9 is a schematic diagram showing the position of small number plates in a third large number plate after applying the second rule between the second large number plate and the third large number plate.

The second rule is then applied between the second large number plate and the third large number plate shown in FIG. 7. Specifically, the four small number plates in the third large number plate are so rotated that the small number plate given the smallest number (Number 9) out of the small number plates assigned to the small blocks with asterisks out of the four small number plates in the third large number plate is positioned in the same row as that in which the small number plate given the largest number (Number 7) out of the small number plates assigned to the small blocks with asterisks out of the four small number plates in the second large number plate is positioned. As a result, the four small number plates in the third large number plate are arranged as shown in FIG. 9.

Figure 10:
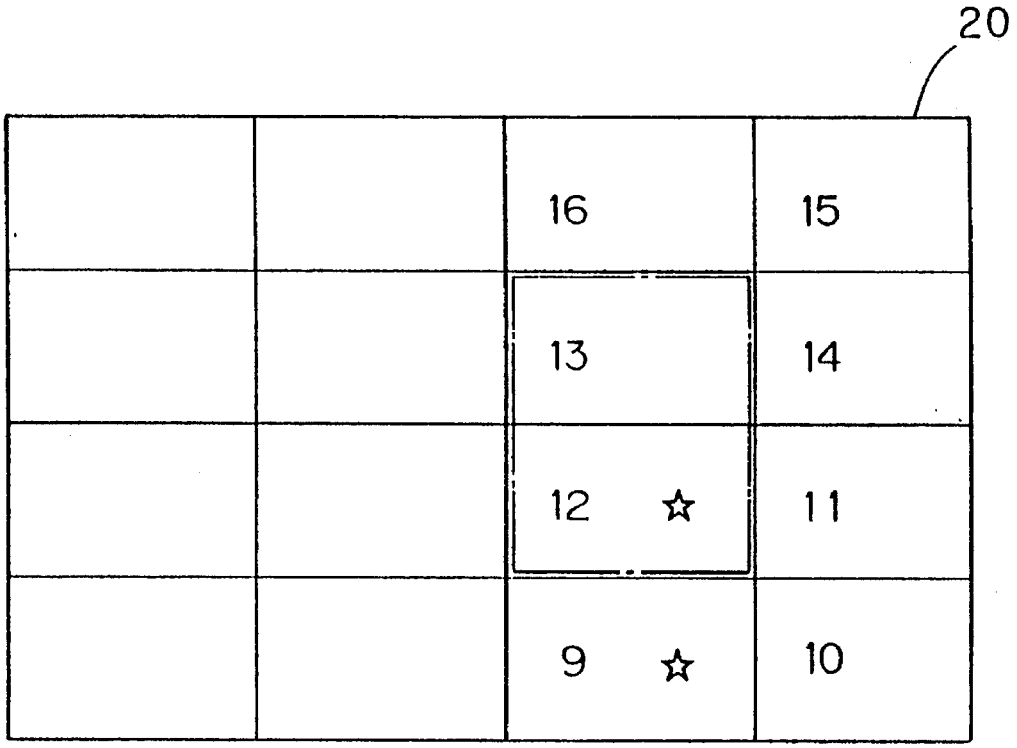
FIG. 10 is a schematic diagram showing the position of small number plates in the third large number plate after applying the second rule between the third large number plate and a fourth large number plate.

The second rule is then applied between the third large number plate and the fourth large number plate shown in FIG. 7. In this case, there exists no asterisk in the large block assigned the fourth large number plate. Accordingly, the four small number plates in the fourth large number plate are so rotated that the small number plate given the smallest number (Number 13) is positioned near the center of the service area 20 as shown in FIG. 10.

Figure 11:
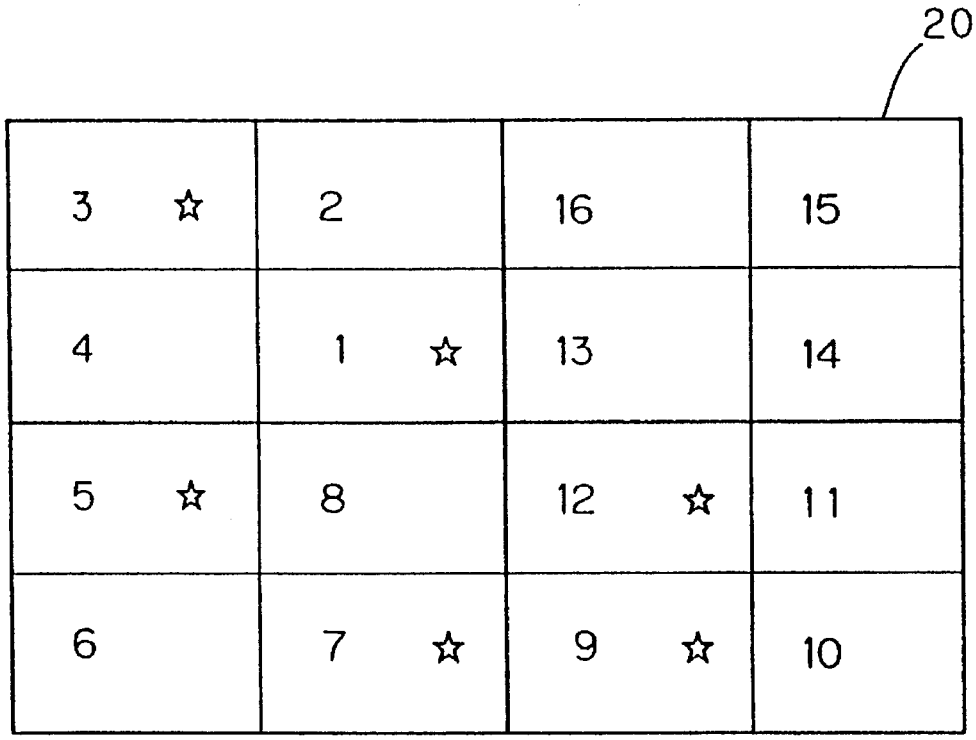
FIG. 11 is a schematic diagram showing the position of all small number plates after applying the first rule and the second rule.
Figure 12:
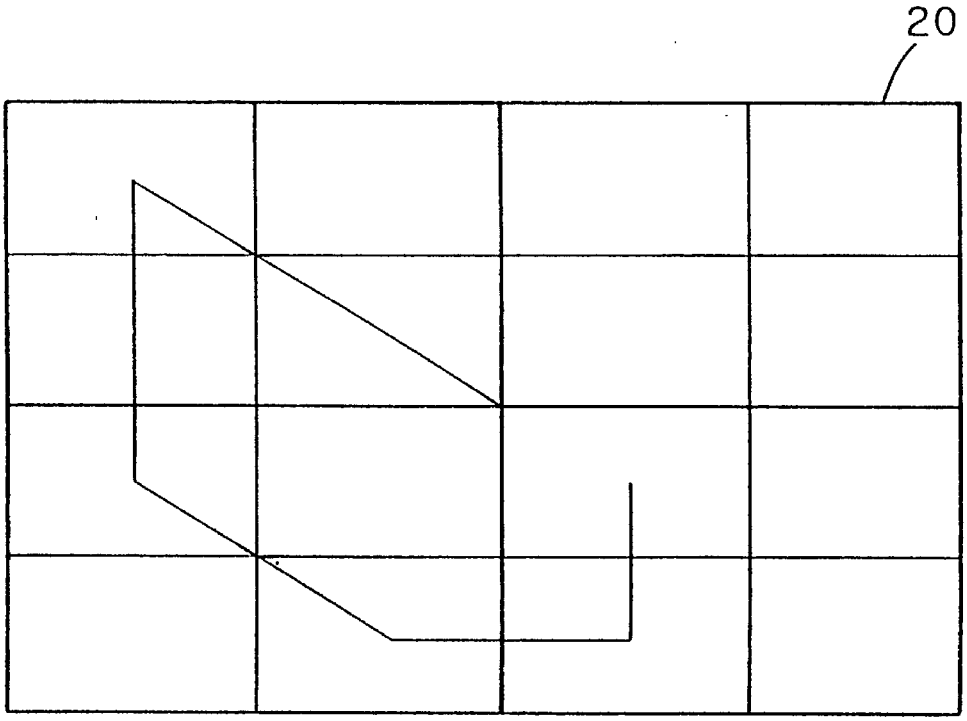
FIG. 12 is a schematic diagram showing the order in which the copying machines are visited for the maintenance work which is found on the basis of FIG. 11.

FIG. 11 shows the position of the small number plates after applying the second rule. Thereafter, the customers for which the maintenance work is to be performed are connected in ascending order of numbers given to the small number plates assigned to the customers, thereby to automatically find a route for the visit, as shown in FIG. 12.

Figure 13:
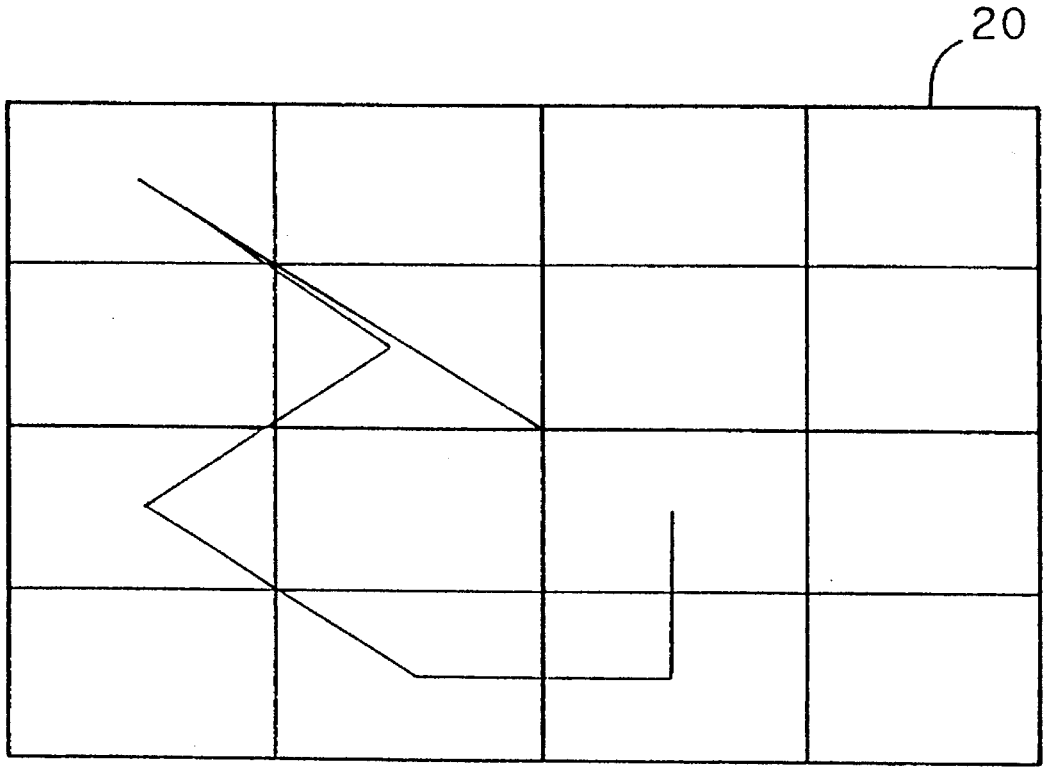
FIG. 13 is a schematic diagram showing the order in which the copying machines are visited for the maintenance work which is arbitrarily found without applying the first rule and the second rule

As a route for visiting the six customers for which the maintenance work is to be performed as shown in FIG. 6, a route as shown in FIG. 13 is also considered. In such a route, a service man must follow a part of the route twice, so that the route wastes a lot of time and labor. On the other hand, the route for the visit shown in FIG. 12 which is found in the above described manner hardly wastes time and labor.

In addition to determining information for efficiently maintaining image forming apparatuses, as discussed above, the present invention can also be used to determine information for efficiently maintaining a variety of peripheral devices which are used with image forming apparatuses. There are several possible arrangements by which the present invention can be employed to provide information for efficiently maintaining such peripheral devices, and each will be discussed in turn.

Figure 14:
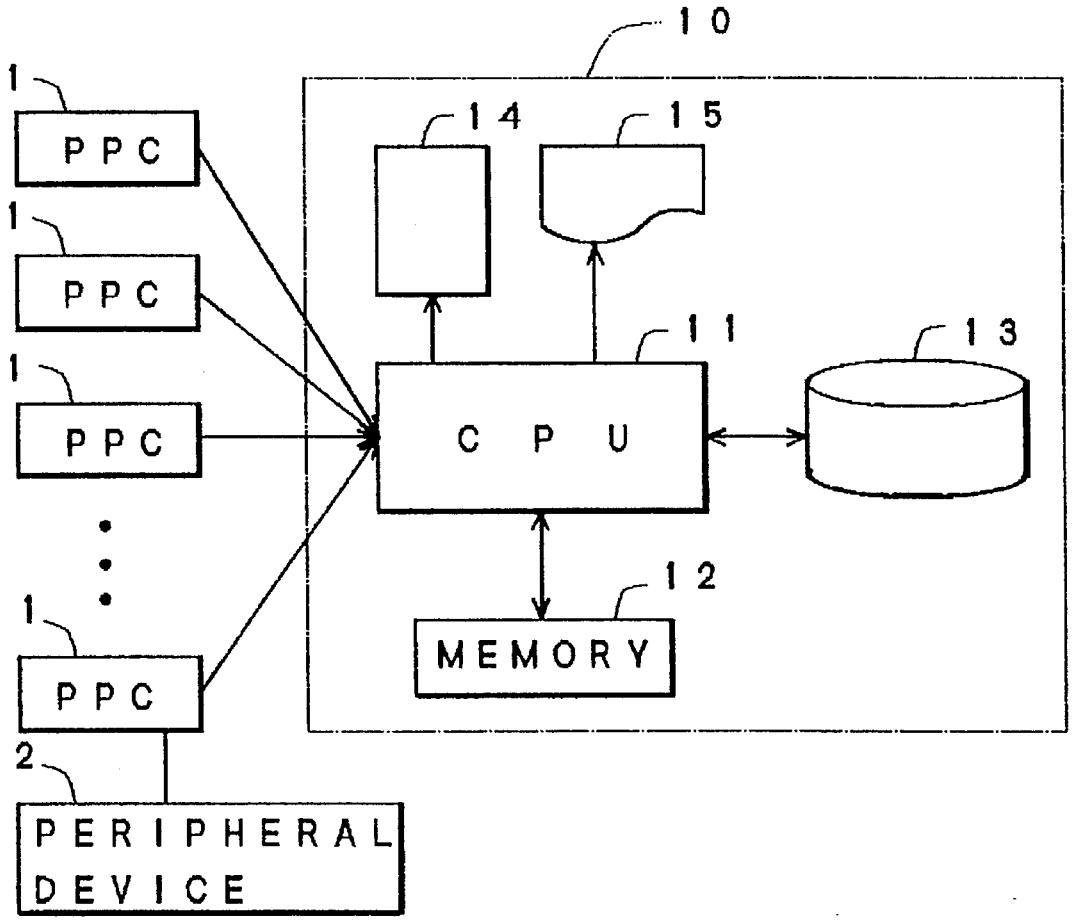
FIG. 14 is a block diagram showing a management system of peripheral devices of copying machines according to another embodiment of the invention.

A first arrangement for providing information for efficiently maintaining peripheral devices is shown in FIG. 14. In this embodiment, maintenance information of a peripheral device (e.g., the number of sheets fed by an automatic document feeder, the number of sheets fed by a sorter, the number of punches made by a punching device, etc.) is first fed to the copying machine 1 to which the peripheral device is attached. This maintenance information is then transmitted from the copying machine 1 to a CPU 11 in a centralized management apparatus 10.

Figure 15:
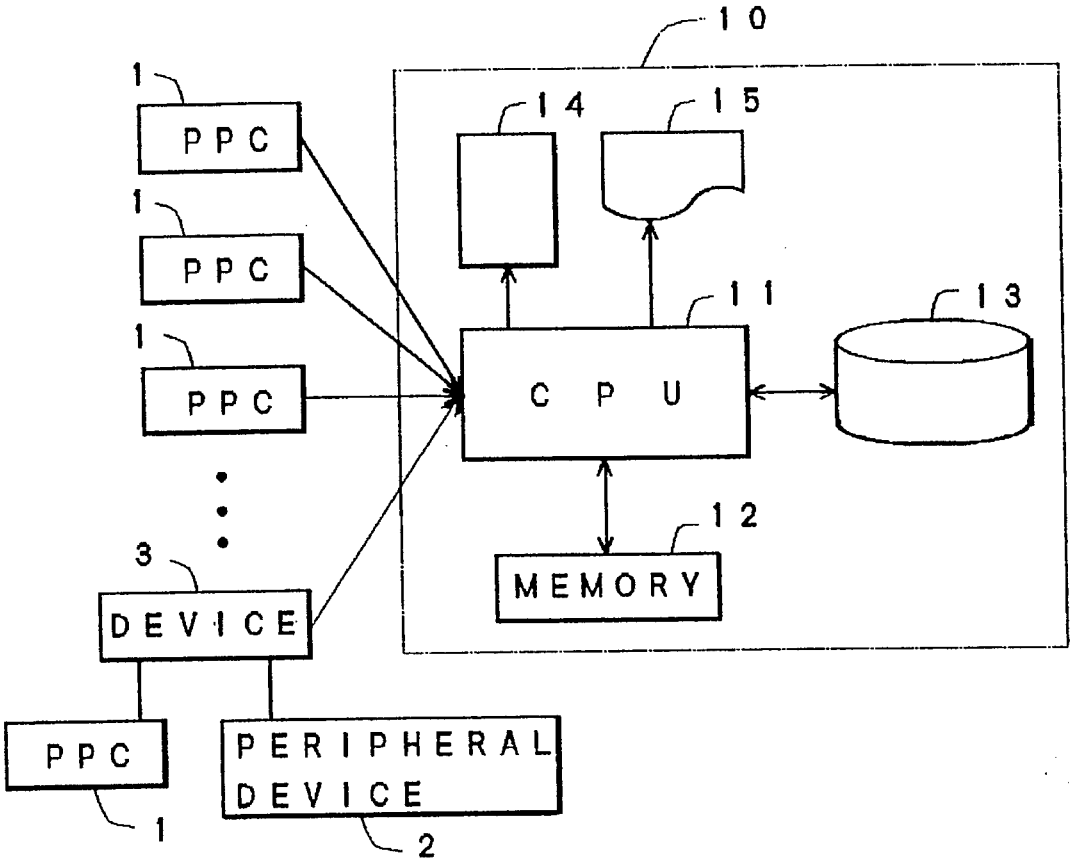
FIG. 15 is a block diagram showing a management system of peripheral devices of copying machines according to yet another embodiment of the invention.

Another arrangement of the invention is illustrated in FIG. 15. With this embodiment, both the maintenance information of the copying machine 1 and the maintenance information of the attached peripheral device 2 are stored in a transmitting device. The maintenance information of both the copying machine and the peripheral device are then transmitted to the CPU 11 of the centralized management apparatus 10.

Figure 16:
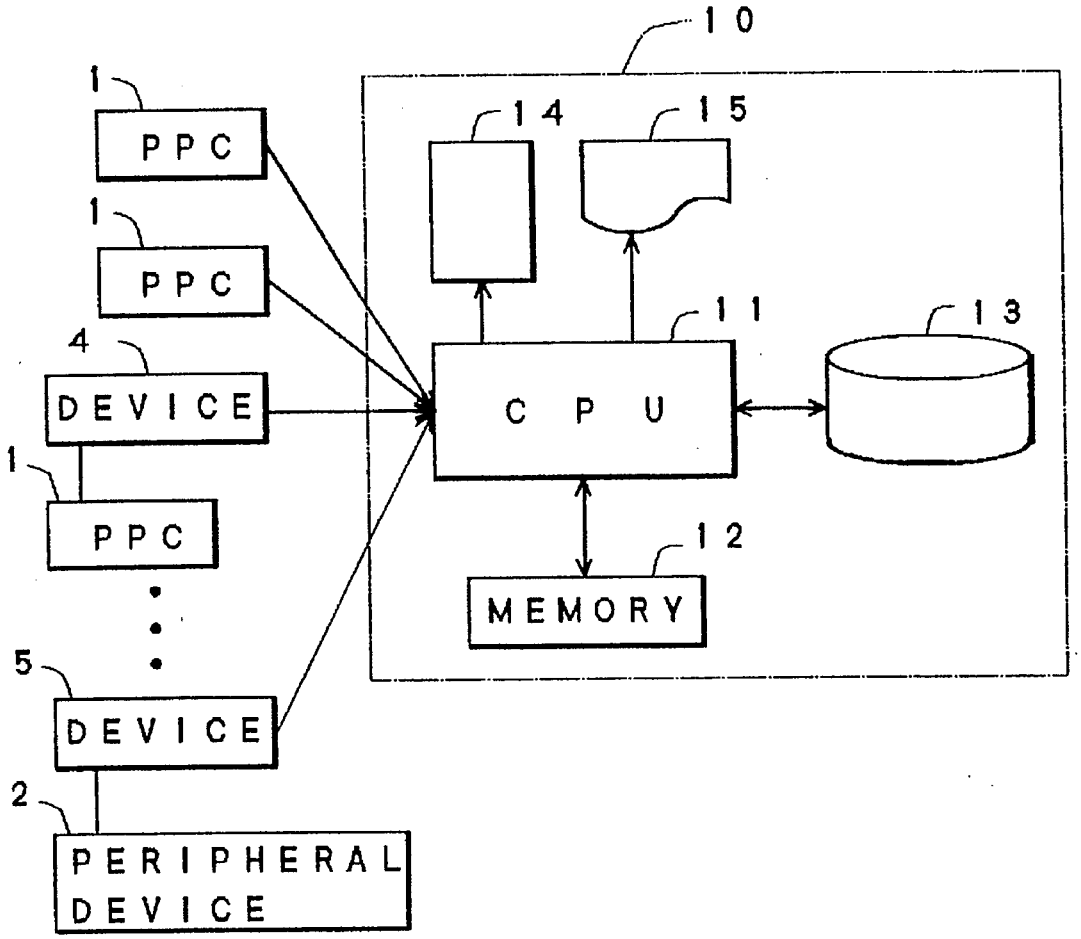
FIG. 16 is a block diagram showing a management system of peripheral devices of copying machines according to still yet another embodiment of the invention.

A third arrangement of the invention is shown in FIG. 16. Here, maintenance information of the copying machine 1 is stored in a transmitting device 4, which then transmits this information to the CPU 11 of the centralized management apparatus 10. Maintenance information of the peripheral device 2, attached to copying machine 1, is stored in a separate transmitting device 5. This maintenance information of the peripheral device 2 is then transmitted to CPU 11 of the centralized management device 10.

Thus, it will be understood that the present invention may be employed to provide information for efficiently maintaining peripheral devices of copying machines, indicating, for example, when these peripheral devices should be scheduled for maintenance. The invention can determine information for efficiently maintaining several different types of peripheral devices, including, but not limited to, automatic document feeders, sorters, paper feeding disk devices, staplers, punching devices, binding devices, and warm heaters, as will be discussed.

Automatic document feeders feed sheets to be copied onto a transparent platen for exposure, and then discharge the sheets from the platen when the exposure is completed. When the invention is employed to determine information for efficiently maintaining the automatic document feeder (e.g., when a document conveying roller of the automatic document feeder is to be replaced), the memory device 13 includes, for each automatic document feeder, areas for storing the number of sheets fed by the feeder per day Q, the average number of sheets fed per day AQ, and the scheduled total number of sheets fed from the time when the maintenance work was last performed until the subsequent maintenance work is to be performed TQO. The memory device 13 also has areas for storing the total number of sheets fed from the time when the maintenance work was last performed up to the present time TQ, and the scheduled date of the subsequent maintenance work D.

The automatic document feeder supplies the centralized management system 10 with the number of fed sheets fed by the automatic document feeder Q each day from each automatic document feeder. The average number of sheets fed per day AQ is found on the basis of the number of fed sheets which is transmitted from the feeder, and is updated every day. The scheduled total number of sheets fed from the time when the maintenance work was last performed until the time when subsequent maintenance work is to be performed TQO is previously set and stored in the memory device 13. The total number of sheets fed from the time when the maintenance work was last performed up to the present time TQ is calculated on the basis of the number of fed sheets which is transmitted from the automatic document feeder, and is updated every day as well.

The number of days X between the scheduled date of the succeeding maintenance work D and the present date is then calculated by the following equation (2):

$$X=(TQO-TQ)/AQ \quad (2)$$

A date after an elapse of the number of days X from the present date is found, and this date is taken as the scheduled date of the succeeding maintenance work D. The scheduled date of the succeeding maintenance work D is updated in this manner every day.

The invention can also be applied to determine information for efficiently maintaining sheet sorters. Sorters sort copied sheets into bins, or trays. There are primarily two types of sorters. The first type sorts copies onto a plurality of stationary bins. The second type of sorters use a plurality of movable bins, which are moved to received copies to be sorted. When the invention is employed to determine information for efficiently maintaining the type of sorter with stationary bins, the memory device 13 includes, for each sorter, areas for storing the number of sheets fed to the sorter per day R, the average number of sheets fed to the sorter per day AR, and the scheduled total number of sheets fed to the sorter from the time when the maintenance work was last performed until the subsequent maintenance work is to be performed TRO. The memory device 13 also has areas for storing the total number of sheets fed to the sorter from the time when the maintenance work was last performed up to the present time TR, and the scheduled date of the subsequent maintenance work D.

The sorter supplies the centralized management system 10 with the number of sheets fed to the sorter R each day from each sorter. The average number of sheets fed per day AR is the calculated on the basis of the number of fed sheets which is transmitted from the sorter, and is updated every day. The scheduled total number of sheets fed to the sorter from the time when the maintenance work was last performed until the time when subsequent maintenance work is to be performed TRO is previously set and stored in the memory device 13. The total number of sheets fed from the time when the maintenance work was last performed up to the present time TR is calculated on the basis of the number of fed sheets which is transmitted from the sorter, and also is updated every day.

The number of days X between the scheduled date of the succeeding maintenance work D and the present date is then calculated by the following equation (3):

$$X=(TRO-TR)/AR \quad (3)$$

A date after an elapse of the number of days X from the present date is found, and this date is taken as the scheduled date of the subsequent maintenance work D. The scheduled date of the subsequent maintenance work D is then updated in this manner every day.

If, on the other hand, the invention is employed to provide information for efficiently maintaining sorters with movable bins, the memory device 13 includes, for each sorter, areas for storing the number of movements of each sorter's bins per day S, the average number of bin movements made per day AS, and the scheduled total number of bin movements from the time when the maintenance work was last performed until the subsequent maintenance work is to be performed TSO. The memory device 13 also has areas for storing the total number of bin movements from the time when the maintenance work was last performed up to the present time TS, and the scheduled date of the subsequent maintenance work D.

For this application, the sorter supplies the centralized management system 10 with the number of the sorter's bin movements S each day from each sorter. The average number of bin movements per day AS is found on the basis of the number of bin movements which is transmitted from the sorter, and which is updated every day. The scheduled total number of bin movements from the time when the maintenance work was last performed until the time when subsequent maintenance work is to be performed TSO is previously set and stored in the memory device 13. The total number of bin movements from the time when the maintenance work was last performed up to the present time TS is calculated on basis of the number of bin movements which is transmitted from the sorter, and is updated every day as well.

The number of days X between the scheduled date of the succeeding maintenance work D and the present date is then calculated by the following equation (4):

$$X=(TSO-TS)/AS \quad (4)$$

Again, a date after an elapse of the number of days X from the present date is found, and this date is taken as the scheduled date of the succeeding maintenance work D. The scheduled date of the succeeding maintenance work D is updated this manner every day.

In this manner, the present invention can be applied to provide information, such as a date when a paper conveying rolled of a sorter should be replaced, for efficiently maintaining sorters with both stationary and movable bins.

Paper feeding disk devices are used to feed paper sheets from a designated paper cassette into the copying machine, and the present invention may be employed to determine maintenance information for one or more of such disk devices. For example, the present invention may be used to calculate the date when a paper feeding conveying roller used with the disk device should be replaced.

When the invention is employed to determine information for efficiently maintaining a paper feeding disk device, the memory device 13 includes, for each disk device, areas for storing the number of sheets fed by the disk device per day U, the average number of sheets fed per day AU, and the scheduled total number of sheets fed from the time when the maintenance work was last performed until the subsequent maintenance work is to be performed TUO. The memory device 13 also has areas for storing the total number of sheets fed by the disk device from the time when the maintenance work was last performed up to the present time TU, and the scheduled date of the succeeding maintenance work D.

The paper feeding disk device supplies the centralized management system 10 with the number of sheets fed by the disk device U each day. The average number of sheets fed per day AU is found on the basis of the number of fed sheets which is transmitted from the disk device, and which is updated every day. The scheduled total number of sheets fed from the time when the maintenance work was last performed until the time when subsequent maintenance work is to be performed TUO is previously set and stored in the memory device 13. The total number of sheets fed from the time when the maintenance work was last performed up to the present time TU is calculated on the basis of the number of fed sheets which is transmitted from the paper feeding disk device, and is updated every day as well.

The number of days X between the scheduled date of the succeeding maintenance work D and the present date is then calculated by the following equation (5):

$$X=(TUO-TU)/AU \quad (5)$$

A date after an elapse of the number of days X from the present date is found, and this date is taken as the scheduled date of the succeeding maintenance work D. The scheduled date of the succeeding maintenance work D is updated in this manner every day.

Staplers are another peripheral device for which information for efficient maintenance can be determined by the present invention. Staplers are used to staple copied sheets together. If the invention is employed to provide information for efficiently maintaining one or more staplers, the memory device 13 includes, for each stapler, areas for storing the number of staplings made by the stapler per day W, the average number of staplings per day AW, and the scheduled total number of staplings from the time when the maintenance work was last performed until the subsequent maintenance work is to be performed TWO. The memory device 13 also has areas for storing the total number of staplings from the time when the maintenance work was last performed up to the present time TW, and the scheduled date of the subsequent maintenance work D.

The stapler supplies the centralized management system 10 with the number of staplings W each day. The average number of staplings per day AW is found on the basis of the number of staplings which is transmitted from the stapler, and which is updated every day. The scheduled total number of staplings from the time when the maintenance work was last performed until the time when subsequent maintenance work is to be performed TWO is previously set and stored in the memory device 13. The total number of staplings from the time when the maintenance work was last performed up to the present time TW is calculated on the basis of the number of staplings which is transmitted from the stapler, and is updated every day as well.

The number of days X between the scheduled date of the succeeding maintenance work D and the present date is then calculated by the following equation (6):

$$X=(TWO-TW)/AW \quad (6)$$

A date after an elapse of the number of days X from the present date is found, and this date is taken as the scheduled date of the succeeding maintenance work D. The scheduled date of the succeeding maintenance work D is updated in this manner every day.

The present invention may also be used to determine information for efficiently maintaining one or more punching devices for punching holes in copied sheets, such as when the punching blade for the punching device should be replaced. When the invention is employed to determine information for efficiently maintaining a punching device, the memory device 13 includes, for each punching device, areas for storing the number of punches by the punching device per day Y, the average number of punches made per day AY, and the scheduled total number of punches made from the time when the maintenance work was last performed until the subsequent maintenance work is to be performed TWO. The memory device 13 also has areas for storing the total number of punches made from the time when the maintenance work was last performed up to the present time TY, and the scheduled date of the succeeding maintenance work D.

The punching device supplies the centralized management system 10 with the number of punches made by the punching device Y each day. The average number of punches made per day AY is found on the basis of the number of punches made which is transmitted from the punching device, and is updated every day. The scheduled total number of punches from the time when the maintenance work was last performed until the time when subsequent maintenance work is to be performed TUO is previously set and stored in the memory device 13. The total number of punches from the time when the maintenance work was last performed up to the present time TY is calculated on the basis of the number of punches transmitted from the punching device, and is updated every day.

The number of days X between the scheduled date of the succeeding maintenance work D and the present date is then calculated by the following equation (6):

$$X=(TUO-TY)/AY \quad (6)$$

A date after an elapse of the number of days X from the present date is found, and this date is taken as the scheduled date of the succeeding maintenance work D. The scheduled date, the succeeding maintenance work D is updated in this manner every day.

The invention can also be employed to determine information for efficiently maintaining a binding device. These binding devices use a paste and a heater to bind copied sheets together. For one such application of the invention, the memory device 13 includes, for each binding device, areas for storing the number of bindings by the binder per day Z, the average number of bindings per day AZ, and the scheduled total number of bindings from the time when the maintenance work was last performed until the subsequent maintenance work is to be performed TYO. The memory device 13 also has areas for storing the total number of bindings from the time when the maintenance work was last performed up to the present time TZ, and the scheduled date of the succeeding maintenance work D.

The binder supplies the centralized management system 10 with the number of bindings Z each day. The average number of bindings per day AZ is calculated on the basis of the number of bindings which is transmitted from the binder, and is updated every day. The scheduled total number of bindings from the time when the maintenance work was last performed until the time when subsequent maintenance work is to be performed TZO is previously set and stored in the memory device 13. The total number of bindings from the time when the maintenance work was last performed up to the present time TZ is calculated on the basis of the number of bindings which is transmitted from the binder, and is updated every day also.

The number of days X between the scheduled date of the succeeding maintenance work D and the present date is then calculated by the following equation (7):

$$X=(TZO-TZ)/AZ \tag{7}$$

Alternatively, the memory device 13 includes, for each binder, areas for storing the driving time of the binder's heater by the binder per day Z', the average of driving time of the heater per day AZ', and the scheduled total driving time of the binder's heater from the time when the maintenance work was last performed until the subsequent maintenance work is to be performed TZ'O. The memory device 13 also alternatively has areas for storing the total heater driving time from the time when the maintenance work was last performed up to the present time TZ'.

With this alternative application of the invention, the binder supplies the centralized management system 10 with the driving time of the binder's heater Z' each day from each binder. The average heater driving time per day AZ' is found on the basis of heater driving time which is transmitted from the binder, and is updated every day. The scheduled total heater driving time from the time when the maintenance work was last performed until the time when subsequent maintenance work is to be performed TZ'O is previously set and stored in the memory device 13. The total heater driving time from the time when the maintenance work was last performed up to the present time TZ' is calculated on the basis of the heater driving time which is transmitted from the binder, and is updated every day as well.

The number of days X between the scheduled date of the succeeding maintenance work D and the present date is then calculated by the following equation (8):

$$X=(TZ'O-TZ')/AZ' \tag{8}$$

For both applications of the present invention to the binder, a date after an elapse of the number of days X from the present date is found, and this date is taken as the scheduled date of the succeeding maintenance work D. The scheduled date of the succeeding maintenance work D is updated in this manner every day.

The present invention can be used to provide information for efficiently maintaining still another peripheral device, the warm heater. The warm heater is used to dehumidify paper sheets in the paper feeding disk device, so as to prevent the paper sheets from absorbing moisture and curling. When the invention is employed to determine maintenance information for such a warm heater, the memory device 13 includes, for each warm heater, areas for storing the drive time of the warm heater per day B, the average drive time of the warm heater per day AB, and the scheduled total drive time of the warm heater from the time when the maintenance work was last performed until the subsequent maintenance work is to be performed TBO. The memory device 13 also has areas for storing the total warm heater drive time from the time when the maintenance work was last performed up to the present time TB, and the scheduled date of the subsequent maintenance work D.

The warm heater supplies the centralized management system 10 with the drive time of the warm heater B each day. The average drive time of the warm heater per day AB is found on the basis of the warm heater drive time which is transmitted from the warm heater, and which is updated every day. The scheduled total warm heater drive time from the time when the maintenance work was last performed until the time when subsequent maintenance work is to be performed TBO is previously set and stored in the memory device 13. The total drive time of the warm heater from the time when the maintenance work was last performed up to the present time TB is calculated on the basis of the warm heater drive time transmitted from the warm heater, and is updated every day.

The number of days X between the scheduled date of the succeeding maintenance work D and the present date is then calculated by the following equation (9):

$$X=(TBO-TB)/AB \tag{9}$$

A date after an elapse of the number of days X from the present date is found, and this date is taken as the scheduled date of the succeeding maintenance work D. The scheduled date of the succeeding maintenance work D is updated in this manner every day.

It will be understood that, once the scheduled date of maintenance for any peripheral device is determined, the order for maintenance is calculated in the same manner as the order of maintenance for the copying machines is calculated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A management system for image forming apparatuses comprising:

means for transmitting the number of images formed by each of a plurality of image forming apparatuses, from each image forming apparatus to a centralized management apparatus; and means for finding, on the basis of the number of formed images transmitted from each of the image forming apparatuses to the centralized management apparatus, the scheduled date of succeeding maintenance work for an image forming apparatus.

2. A management system of a peripheral device for image forming apparatuses comprising:

means for transmitting information concerning maintenance of a peripheral device for image forming apparatuses to a centralized management apparatus; and means for finding, on the basis of said information concerning maintenance of the peripheral device which is transmitted to said centralized management apparatus, the scheduled date of succeeding maintenance work for said peripheral device.

3. The management system of a peripheral device for image forming apparatuses according to claim 2, wherein said peripheral device is an automatic document feeder, and said information concerning maintenance is the number of documents fed by the automatic document feeder.

4. The management system of a peripheral device for image forming apparatuses according to claim 3, wherein the number of documents fed by said automatic document feeder is transmitted from said transmitting means to said centralized management apparatus for each predetermined time period, said centralized management apparatus including storing means which is provided with a first storage area for storing the average number of documents fed by said automatic document feeder per day, a second storage area for storing the scheduled total number of documents fed by said automatic document feeder from the time when a preceding maintenance work is performed until succeeding maintenance work is performed, and a third storage area for storing the total number of documents fed by said automatic document feeder from the time when the preceding maintenance work is performed up to the present time, means for finding, on the basis of the number of documents fed from said transmitting means for each predetermined time period, the average number of documents fed per day and storing the same in said first storage area, means for finding, on the basis of the number of documents fed from said transmitting means for each predetermined time period, the total number of documents fed by said automatic document feeder from the time when the preceding maintenance work is performed up to the present time and storing the same in said third storage area, means for subtracting the total number of documents which is stored in said third storage area from the scheduled total number of documents which is stored in said second storage area, dividing the result of the subtraction by the average number of documents fed per day to find the difference between the scheduled date of the succeeding maintenance work and the present date, and finding the scheduled date of the succeeding maintenance work on the basis of the difference and the present date, and means for reporting the scheduled date of the succeeding maintenance work found.

5. The management system of a peripheral device for image forming apparatuses according to claim 2, wherein said peripheral device is a sorter of such a type that paper sheets are sorted into a plurality of bins (trays) fixed, and said information concerning maintenance is the number of paper sheets fed to the sorter.

6. The management system of a peripheral device for image forming apparatuses according to claim 5, wherein the number of paper sheets fed to said sorter is transmitted from said transmitting means to said centralized management apparatus for each predetermined time period, said centralized management apparatus including storing means which is provided with a first storage area for storing the average number of paper sheets fed to said sorter per day, a second storage area for storing the scheduled total number of paper sheets fed to said sorter from the time when a preceding maintenance work is performed until succeeding maintenance work is performed, and a third storage area for storing the total number of paper sheets fed to said sorter from the time when the preceding maintenance work is performed up to the present time, means for finding, on the basis of the number of paper sheets fed from said transmitting means for each predetermined time period, the average number of paper sheets per day and storing the same in said first storage area, means for finding, on the basis of the number of paper sheets fed from said transmitting means for each predetermined time period, the total number of paper sheets fed to said sorter from the time when the preceding maintenance work is performed up to the present time and storing the same in said third storage area, means for subtracting the total number of paper sheets which is stored in said third storage area from the scheduled total number of paper sheets which is stored in said second storage area, dividing the result of the subtraction by the average number of paper sheets per day to find the difference between the scheduled date of the succeeding maintenance work and the present date, and finding the scheduled date of the succeeding maintenance work on the basis of the difference and the present date, and means for reporting the scheduled date of the succeeding maintenance work found.

7. The management system of a peripheral device for image forming apparatuses according to claim 2, wherein said peripheral device is a sorter of such a type that paper sheets are sorted by up-and-down movement of a plurality of bins (trays), and said information concerning maintenance is the number of movements of the bins.

8. The management system of a peripheral device for image forming apparatuses according to claim 7, wherein the number of movements of the bins in said sorter is transmitted from said transmitting means to said centralized management apparatus for each predetermined time period, said centralized management apparatus including storing means which is provided with a first storage area for storing the average number of movements of the bins in said sorter per day, a second storage area for storing the scheduled total number of movements of the bins in said sorter from the time when a preceding maintenance work is performed until succeeding maintenance work is performed, and a third storage area for storing the total number of movements of the bins in said sorter from the time when the preceding maintenance work is performed up to the present time, means for finding, on the basis of the number of movements of the bins fed from said transmitting means for each predetermined time period, the average number of movements of the bins per day and storing the same in said first storage area, means for finding, on the basis of the number of movements of the bins fed from said transmitting means for each predetermined time period, the total number of movements of the bins in said sorter from the time when the preceding maintenance work is performed up to the present time and storing the same in said third storage area, means for subtracting the total number of movements of the bins which is stored in said third storage area from the scheduled total number of movements of the bins which is stored in said second storage area, dividing the result of the subtraction by said average number of movements of the bins per day to find the difference between the scheduled date of the succeeding maintenance work and the present date, and finding the scheduled date of the succeeding maintenance work on the basis of the difference and the present date, and means for reporting the scheduled date of the succeeding maintenance work found.

9. The management system of a peripheral device for image forming apparatuses according to claim 2, wherein said peripheral device is a paper feeding disk device containing a plurality of paper feeding cassettes for feeding paper sheets from a designated cassette into each of the image forming apparatuses, and said information concerning maintenance is the number of paper sheets fed by the paper feeding disk device.

10. The management system of a peripheral device for image forming apparatuses according to claim 9, wherein the number of paper sheets fed by said paper feeding disk device is transmitted from said transmitting means to said centralized management apparatus for each predetermined time period, said centralized management apparatus including storing means which is provided with a first storage area for storing the average number of paper sheets fed by said paper feeding disk device per day, a second storage area for storing the scheduled total number of paper sheets fed by said paper feeding disk device from the time when preceding maintenance work is performed until succeeding maintenance work is performed, and a third storage area for storing the total number of paper sheets fed by said paper feeding disk device from the time when the preceding maintenance work is performed up to the present time, means for finding, on the basis of the number of paper sheets fed from said transmitting means for each predetermined time period, the average number of paper sheets per day and storing the same in said first storage area, means for finding, on the basis of the number of paper sheets fed from said transmitting means for each predetermined time period, the total number of paper sheets fed by said paper feeding disk device from the time when the preceding maintenance work is performed up to the present time and storing the same in said third storage area, means for subtracting the total number of paper sheets fed which is stored in said third storage area from the scheduled total number of paper sheets fed which is stored in said second storage area, dividing the result of the subtraction by the average number of paper sheets fed per day to find the difference between the scheduled date of the succeeding maintenance work and the present date, and finding the scheduled date of the succeeding maintenance work on the basis of the difference and the present date, and means for reporting the scheduled date of the succeeding maintenance work found.

11. The management system of a peripheral device for image forming apparatuses according to claim 2, wherein said peripheral device is a stapler for stapling a plurality of paper sheets discharged, and said information concerning maintenance is the number of stapling operations by said stapler.

12. The management system of a peripheral device for image forming apparatuses according to claim 11, wherein the number of stapling operations by said stapler is transmitted from said transmitting means to said centralized management apparatus for each predetermined time period, said centralized management apparatus including storing means which is provided with a first storage area storing the average number of stapling operations by said stapler per day, a second storage area for storing the scheduled total number of stapling operations by said stapler from the time when preceding maintenance work is performed until succeeding maintenance work is performed, and a third storage area for storing the total number of stapling operations by said stapler from the time when the preceding maintenance work is performed up to the present time, means for finding, on the basis of the number of stapling operations fed from said transmitting means for each predetermined time period, the average number of stapling operations per day and storing the same in said first storage area, means for finding, on the basis of the number of stapling operations fed from said transmitting means for each predetermined time period, the total number of stapling operations by said stapler from the time when the preceding maintenance work is performed up to the present time and storing the same in said third storage area, means for subtracting the total number of stapling operations which is stored in said third storage area from the scheduled total number of stapling operations which is stored in said second storage area, dividing the result of the subtraction by the average number of stapling operations per day to find the difference between the scheduled date of the succeeding maintenance work and the present date, and finding the scheduled date of the succeeding maintenance work on the basis of the difference and the present date, and means for reporting the scheduled date of the succeeding maintenance work found.

13. The management system of a peripheral device for image forming apparatuses according to claim 2, wherein said peripheral device is a punching device for punching one or a plurality of paper sheets discharged, and said information concerning maintenance is the number of punching by the punching operations device.

14. The management system of a peripheral device for image forming apparatuses according to claim 13, wherein the number of punching operations by said punching device is transmitted from said transmitting means to said centralized management apparatus for each predetermined time period, said centralized management apparatus including storing means which is provided with a first storage area for storing the average number of punching operations by said punching device per day, a second storage area for storing the scheduled total number of punching operations by said punching device from the time when preceding maintenance work is performed until succeeding maintenance work is performed, and a third storage area for storing the total number of punching operations by said punching device from the time when the preceding maintenance work is performed up to the present time, means for finding, on the basis of the number of punching operations fed from said transmitting means for each predetermined time period, the average number of punching operations by said punching device per day and storing the same in said first storage area, means for finding, on the basis of the number of punching operations fed from said transmitting means for each predetermined time period, the total number of punching operations by said punching device from the time when the preceding maintenance work is performed up to the present time and storing the same in said third storage area, means for subtracting the total number of punching operations which is stored in said third storage area from the scheduled total number of punching operations which is stored in said second storage area, dividing the result of the subtraction by the average number of punching operations per day to find the difference between the scheduled date of the succeeding maintenance work and the present date, and finding the scheduled date of the succeeding maintenance work on the basis of the difference and the present date, and means for reporting the scheduled date of the succeeding maintenance work found.

15. The management system of a peripheral device for image forming apparatuses according to claim 2, wherein said peripheral device is a binding device for binding a plurality of paper sheets discharged, and said information concerning maintenance is the number of binding operations by the binding device.

16. The management system of a peripheral device for image forming apparatuses according to claim 15, wherein the number of binding operations by said binding device is transmitted from said transmitting means to said centralized management apparatus for each predetermined time period, said centralized management apparatus including storing means which is provided with a first storage area for storing the average number of binding operations by said binding device per day, a second storage area for storing the scheduled total number of binding operations by said binding device from the time when preceding maintenance work is performed until succeeding maintenance work is performed, and a third storage area for storing the total number of binding operations by said binding device from the time when the preceding maintenance work is performed up to the present time, means for finding, on the basis of the number of binding operations fed from said transmitting means for each predetermined time period, the average number of binding operations per day and storing the same in said first storage area, means for finding, on the basis of the number of binding operations fed from said transmitting means for each predetermined time period, the total number of binding operations by said binding device from the time when the preceding maintenance work is performed up to the present time and storing the same in said third storage area, means for subtracting the total number of binding operations which is stored in said third storage area from the scheduled total number of binding operations which is stored in said second storage area, dividing the result of the subtraction by the average number of binding operations per day to find the difference between the scheduled date of the succeeding maintenance work and the present date, and finding the scheduled date of the succeeding maintenance work on the basis of the difference and the present date, and means for reporting the scheduled date of the succeeding maintenance work found.

17. The management system of a peripheral device for image forming apparatuses according to claim 2, wherein said peripheral device is a binding device having a heater for pasting and heating a plurality of paper sheets discharged, and said information concerning maintenance is the driving time of the heater.

18. The management system of a peripheral device for image forming apparatuses according to claim 17, wherein the driving time of said heater is transmitted from said transmitting means to said centralized management apparatus for each predetermined time period, said centralized management apparatus including storing means which is provided with a first storage area for storing the average driving time of said heater per day, a second storage area for storing the scheduled total driving time of said heater from the time when preceding maintenance work is performed until succeeding maintenance work is performed, and a third storage area for storing the total driving time of said heater from the time when the preceding maintenance work is performed up to the present time, means for finding, on the basis of the driving time fed from said transmitting means for each predetermined time period, the average driving time per day and storing the same in said first storage area, means for finding, on the basis of the driving time fed from said transmitting means for each predetermined time period, the total driving time of said binding device from the time when the preceding maintenance work is performed up to the present time and storing the same in said third storage area, means for subtracting the total driving time which is stored in said third storage area from the scheduled total driving time which is stored in said second storage area, dividing the result of the subtraction by the average driving time per day to find the difference between the scheduled date of the succeeding maintenance work and the present date, and finding the scheduled date of the succeeding maintenance work on the basis of the difference and the present date, and means for reporting the scheduled date of the succeeding maintenance work found.

19. The management system of a peripheral device for image forming apparatuses according to claim 2, wherein said peripheral device is a warming heater provided in the paper feeding disk device for warming paper sheets, and said information concerning maintenance is the driving time of the warmer heater.

20. The management system of a peripheral device for image forming apparatuses according to claim 19, wherein the driving time of said warmer heater is transmitted from said transmitting means to said centralized management apparatus for each predetermined time period, said centralized management apparatus including storing means which is provided with a first storage area for storing the average driving time of said warmer heater per day, a second storage area for storing the scheduled total driving time of said warmer heater from the time when preceding maintenance work is performed until succeeding maintenance work is performed, and a third storage area for storing the total driving time of said warmer heater from the time when the preceding maintenance work is performed up to the present time, means for finding, on the basis of the driving time fed from said transmitting means for each predetermined time period, the average driving time per day and storing the same in said first storage area, means for finding, on the basis of the driving time fed from said transmitting means for each predetermined time period, the total driving time of said warmer heater from the time when the preceding maintenance work is performed up to the present time and storing the same in said third storage area, means for subtracting the total driving time which is stored in said third storage area from the scheduled total driving time which is stored in said second storage area, dividing the result of the subtraction by the average driving time per day to find the difference between the scheduled date of the succeeding maintenance work and the present date, and finding the scheduled date of the succeeding maintenance work on the basis of the difference and the present date, and means for reporting the scheduled date of the succeeding maintenance work found.

* * * * *